United States Patent [19]

Arnsteiner

[11] 4,382,610

[45] May 10, 1983

[54] SKI WITH LAYERED CONSTRUCTION

[75] Inventor: Anton Arnsteiner, Mittersill, Austria

[73] Assignee: Blizzard Gesellschaft m.b.H., Mittersill, Austria

[21] Appl. No.: 235,949

[22] Filed: Feb. 19, 1981

[30] Foreign Application Priority Data

Feb. 20, 1980 [AT] Austria ..... 926/80

[51] Int. Cl.[3] ..... A63C 5/12

[52] U.S. Cl. ..... 280/610

[58] Field of Search ..... 280/610

[56] References Cited

U.S. PATENT DOCUMENTS 3,816,573 6/1974 Hashimoto et al. ..... 280/610

3,901,522 8/1975 Boehm ..... 280/610

4,093,268 6/1978 Sampson et al. ..... 280/610

*Primary Examiner*—David M. Mitchell

*Assistant Examiner*—Timothy Roesch

*Attorney, Agent, or Firm*—Toren, McGeady and Stanger

[57] ABSTRACT

A ski is constructed of a top plate separated from a bottom plate by a core made of a material elastic in shear. Each of the top plate and bottom plate is formed of at least two layers, one above the other, with one layer having a higher coefficient of linear expansion than the other. The thicknesses and positional sequence of the layers are asymmetrically arranged with respect to the longitudinal center plane of the ski. The thicknesses of the layers varies considerably between the top and bottom plates.

9 Claims, 3 Drawing Figures

SKI WITH LAYERED CONSTRUCTION

SUMMARY OF THE INVENTION

The present invention is directed to a ski including a top plate separated from a bottom plate by a core with both the top plate and bottom plate each consisting of at least two layers of different materials with one of the layers having a higher coefficient of linear expansion than the other layer.

There are known skis in which the top plate and the bottom plate are formed of several layers. The core separating the two plates consists of polyurethane with a glass fiber layer extending along both sides of the core. An additional layer is included in the form of an aluminum plate. Relative to the longitudinal central plane of the ski, the layers are arranged in their positional sequence as well as in thickness in both the top plate and the bottom plate so that they are symmetrical with respect to one another about the central plane. In such an arrangement the possible effects of tension are mutually cancelled due to the interconnection of materials having different coefficients of linear expansion.

In addition, in a known embodiment, the ski is formed of layers or groups of layers above and below the neutral horizontal plane of the ski with the materials forming the layers having different coefficients of thermal expansion. In such an arrangement, at 0° C. a limited initial stress exists in the ski and at −25° C. there is a large initial stress. Such a construction, however, is directly contrary to the requirements of a skier because when the skiing surface is cold and hard a lesser initial stress is required, and when the surface is less cold and softer, a greater initial stress is required.

Therefore, it is the primary object of the present invention to provide a ski in which the initial stress or the distribution of the surface pressure is changed according to the requirements, that is, in dependence on the ambient temperature.

In accordance with the present invention, the layers in the top plate and the bottom plate, relative to the longitudinal central plane of the ski, are arranged asymmetrically in their position and in their thickness. Further, the thicknesses of the layers in the top plate and the bottom plate differ considerably. The two plates are interconnected by a core formed of a material elastic in shear, that is, a yieldable material.

Effective changes in the initial stress in the ski can be accomplished in accordance with the present invention. During in-depth tests it has become evident that, only in the arrangement of the ski embodying the present invention, a maximum initial stress reduction of 35 to 40% can be achieved in the temperature range of +25° to −25° C. This effect is accomplished by the asymmetrical arrangement of the different layers and by the different thicknesses of the layers so that the top plate and bottom plate do not function in opposite directions, that is, to mutually cancel the effect, rather an overlapping of the changes in the length takes place in an exactly regulated manner.

This special effect is also aided by the core formed of a material which is elastic in shear and extends between the top plate and the bottom plate. This core makes it possible to transfer the shearing forces caused by the top plate and the bottom plate.

Further, in accordance with the present invention, the thermal contraction or expansion is significantly stronger in the top plate than in the bottom plate with the result that, during a reduction in temperature, there is a corresponding reduction in initial stresses.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 2:
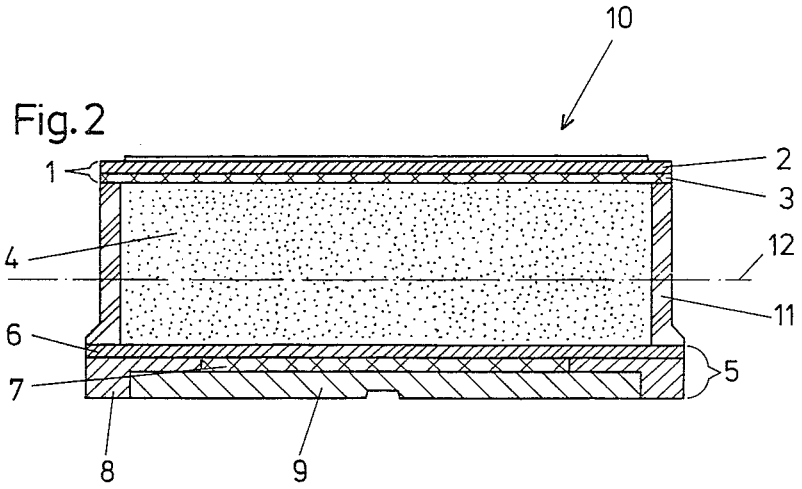
FIG. 2 is a cross-sectional view on an enlarged scale taken along the line I—I in FIG. 1.

As can be seen in FIG. 2, ski 10 is formed of a top plate 1 and a bottom plate 5 with a core 5 extending between the top and bottom plates. A sheathing or side covering 11 extends along the longitudinal sides of the core 4 and between the top and bottom plates. The top plate and the bottom plate each consist of at least two layers 2, 3 and 6, 7 with each layer being formed of a different material. One of the materials forming the layers 2, 3 and 6, 7 has a higher coefficient of linear expansion than the other material. The ski 10 has a longitudinal central plane 12 extending through the core and these different layers in the top plate and bottom plate are arranged asymmetrically in their positional sequence and also in thickness relative to the central plane. In other words, the materials with the larger coefficient of thermal expansion are not located in the top and bottom plate closer to the central plane than the material having the smaller coefficient. Further, the thickness of the layers 2, 3, 6 and 7 in the top and bottom plates differ considerably. The core 4 is constructed of a material which is yieldable or elastic in shear.

Layers 2 and 6 have the larger coefficient of linear expansion and the thickness of the layer 2 in the top plate is greater than the layer 6 in the bottom plate. The thickness of the layers 3 and 7, having the smaller coefficient of layer expansion, is smaller in the top plate 1 than in the bottom plate 5. Consequently, the thermal contraction or expansion is significantly stronger in the top plate than in the bottom plate as a result of the corresponding reduction in initial stress resulting during a drop in temperature.

It can also be noted in the drawing that in the top plate the thickness of the layer 2 having the larger coefficient of linear expansion is greater than the thickness of the layer 3 having the smaller coefficient of linear expansion. In the bottom plate, however, the layer 6 having the larger coefficient of thermal expansion has a smaller thickness than the layer 7 having the smaller coefficient of linear expansion.

In this way, a ski with an initial tension, depending on temperature, can be obtained because, in the top plate and the bottom plate of the ski, materials with different temperature-dependent coefficients of linear expansion are used and these materials are interconnected with one another by the core 4 formed of a material elastic in shear. The layers 2, 6 use a material having a coefficient of linear expansion in the range of 20 to $30\times10^{-6}$ $grad^{-1}$. The layers 3 and 7 use materials with a coefficient of linear expansion in the range of 5 to $12\times10^{-6}$ $grad^{-1}$.

It is advantageous to form the layers 2, 6 having the larger coefficient of thermal expansion of aluminum and to form the layers 3, 7 with the smaller coefficient of linear expansion of a glass laminate.

In the illustrated embodiment, note FIG. 2, the top plate 1 consists of an upper layer 2 of aluminum alloy having a thickness of 0.8 mm and a lower layer 3 of fiber glass laminate having a thickness of 0.4 mm. Glass-reinforced polyurethane is used as the material for the core 4. In bottom plate 5, the upper layer 6 of aluminum alloy has a thickness of 0.7 mm while the lower layer 7 of a fiber glass laminate has a thickness of 0.9 mm. The bottom plate 5 of the ski is completed by a pair of longitudinally extending steel edges 8 each extending along one side of the layer 7 and below the layer 6. A polyethylene layer 9 extends across the bottom of the ski between the inside surfaces of the edges 8 and forms the bottom surface of the ski. These materials are glued together by an epoxy adhesive.

In the embodiment of the present invention, the materials used in the top plate and the bottom plate are selected so that in the temperature range of +25° C. to −25° C. a maximum reduction in initial stress of 35 to 40% results. This effect is achieved by the asymmetrical arrangement of the layers having the larger and smaller coefficients of linear expansion in both the top plate and the bottom plate. The core 4 formed of a material which is elastic in shear contributes to the reduction in initial stress due to its shear-elastic behavior. By selectively dimensioning the layers having the smaller coefficient of linear expansion, the change in initial stress is limited so that the temperature expansion of the materials with the larger coefficient of thermal expansion is limited by the materials with the smaller coefficient of linear expansion. Consequently, in accordance with the present invention, a change in the distribution of surface pressure, dependent on the initial stress, is possible with an adjustment of the distribution of surface pressure and edge pressure taking place in accordance with the different resistance afforded by the skiing surface. As a result, the initial stress is reduced where the skiing surface is cold and hard and the initial stress is increased when the skiing surface is warm and soft.

Figure 1:
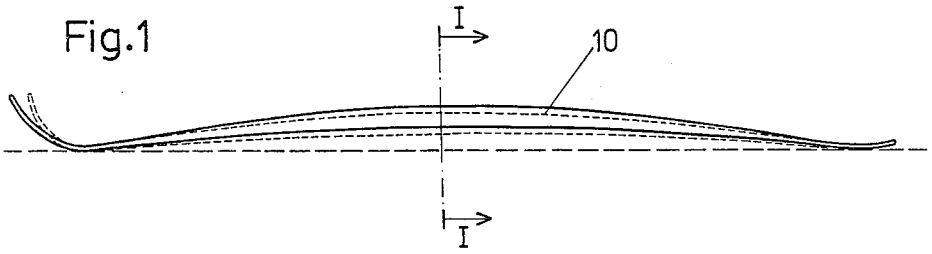
FIG. 1 is side view of a ski embodying the present invention.

In FIG. 1 a side view of the ski 10 is provided with the largest initial stress shown in solid line. A lower initial stress is illustrated by the broken line.

Figure 3:
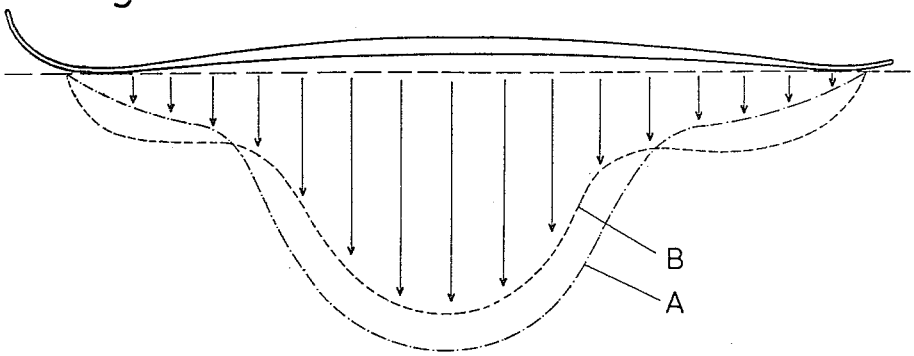
FIG. 3 is a side view of the ski embodying the present invention showing the distribution of surface pressure.

FIG. 3 exhibits the distribution of surface pressure developed by the ski with the initial stress being shown by the curves A and B. During a relatively lower temperature, the distribution surface pressure is shown by curve A which results from a correspondingly lower initial stress. Thus, the edge pressure in the forward and rearward control regions of the ski is reduced, while in the center region of the ski the edge pressure and surface pressure is increased. During relatively high temperatures, a distribution of the surface pressure is displayed by curve B and results in the surface pressure and the edge pressure in the center region of the ski being reduced while the comparable pressures in the forward and rearward control regions of the ski are increased. Accordingly, the edge engagement of the ski is increased on a hard, cold skiing surface in the center region of the ski and is decreased in the forward and rearward control regions. Skis having this distribution of surface pressure and edge pressure are easier to turn on cold, hard skiing surfaces with higher surface resistance and are less inclined to cross. During warmer ambient conditions (air, snow) the pressure increases in the control region so that improved guidance of the ski is achieved when the surface resistance is lower.

While specific embodiments of the invention have been shown and described in detail to illustrate the application of the inventive principles, it will be understood that the invention may be embodied otherwise without departing from such principles.

What is claimed is:

1. Ski having a longitudinally extending central plane with a top plate located above the plane, a bottom plate located below the plane and a core extending between said top plate and said bottom plate, each of said top plate and bottom plate comprises at least two layers one above the other and each of the layers in said top plate and bottom plate being formed of materials having a different coefficient of linear expansion so that said top plate and bottom plate each comprises a larger coefficient of linear expansion layer and a smaller coefficient of linear expansion layer, wherein the improvement comprises that said larger coefficient layer and said smaller coefficient layer in said top and bottom plates are arranged asymmetrically relative to the longitudinal central plane of the ski with respect to the positional sequence of said layers and with respect to the thickness of said layers, the thickness of said larger and smaller coefficient layers in said top plate and said bottom plate being different, the thickness of said larger coefficient layer in said top plate is greater than the thickness of said larger coefficient layer in said bottom plate and the thickness of said smaller coefficient layer in said top plate is smaller than the thickness of said smaller coefficient layer in said bottom plate.

2. Ski, as set forth in claim 1, wherein the thickness of said larger coefficient layer in said top plate being greater than the thickness of said smaller coefficient layer in said top plate.

3. Ski, as set forth in claim 1, wherein said larger coefficient layers in said top plate and said bottom plate being formed of aluminum and said smaller coefficient layers in said top plate and said bottom plate being formed of a fiber glass laminate.

4. Ski, as set forth in claim 1, wherein said core interconnects said top plate and bottom plate being formed of a polyurethane reinforced with glass fibers which is elastic in shear.

5. Ski, as set forth in claim 3, wherein said larger coefficient layer in said top plate having a thickness of 0.8 mm and being formed of an aluminum alloy and said smaller coefficient layer in said top plate having a thickness of 0.4 mm and being formed of a fiber glass laminate, said larger coefficient layer in said bottom plate having a thickness of 0.7 mm and being formed of an aluminum alloy and said smaller coefficient layer in said bottom plate having a thickness of 0.9 mm and being formed of a fiber glass laminate.

6. Ski, as set forth in claim 1, wherein the longitudinally extending edges of said smaller coefficient layer in said bottom plate being recessed inwardly from the corresponding longitudinally extending edges of said larger coefficient layer in said bottom plate, a steel edge forming the bottom edge along each of the opposite longitudinally extending sides of the ski with each steel edge extending along an opposite longitudinally extending edge of said smaller coefficient layer in said bottom plate.

7. Ski, as set forth in claim 6, wherein said steel edges project downwardly from the lower surface of said smaller coefficient layer in said bottom plate, and a layer of polyethylene extending between said steel edges and along the bottom surface of said smaller coefficient layer and forming the bottom surface of the ski.

8. Ski, as set forth in claim 6, wherein an epoxy adhesive secures said larger and smaller coefficient layers in said top and bottom plates, said core, said steel edges, and said polyurethane bottom surface together.

9. Ski, as set forth in claim 1, wherein the coefficient of linear expansion of the larger coefficient layers on said top plate and bottom plate being in the range of 20 to $30\times10^{-6}$ grad$^{-1}$, and the coefficient of linear expansion of the smaller coefficient layers in said top plate and bottom plate being in the range of 5 to $12\times10^{-6}$ grad$^{-1}$.

* * * * *